US005752330A

United States Patent [19]

Snabb

[11] Patent Number: 5,752,330

[45] Date of Patent: May 19, 1998

[54] ATHLETIC SHOES WITH REVERSE SLOPE SOLE CONSTRUCTION

[76] Inventor: John C. Snabb, 3440 Dorothea Ct., Troy, Mich. 48084

[21] Appl. No.: 603,752

[22] Filed: Feb. 20, 1996

Related U.S. Application Data

[63] Continuation-in-part of Ser. No. 166,243, Dec. 13, 1993, Pat. No. 5,491,912, which is a continuation-in-part of Ser. No. 896,222, Jun. 10, 1992, abandoned.

[51] Int. Cl.[6] ..... A43B 5/00; A43B 3/00; A43B 13/00

[52] U.S. Cl. ..... 36/114; 36/25 R; 36/127

[58] Field of Search ..... 36/25 R, 91, 103, 36/106, 114, 11.5, 140, 88

[56] References Cited

U.S. PATENT DOCUMENTS

| | | | |
|---|---|---|---|
| 2,518,649 | 8/1950 | Tydings et al. | 36/11.5 X |
| 2,769,252 | 11/1956 | Monier | 36/140 |
| 3,305,947 | 2/1967 | Kalsoy | 36/91 |
| 3,964,181 | 6/1976 | Holcombe, Jr. | 36/91 |
| 3,990,159 | 11/1976 | Borgeas | 36/101 |
| 4,041,619 | 8/1977 | Sapper | 36/103 X |
| 4,589,216 | 5/1986 | Fuscone | 36/25 R X |
| 4,934,073 | 6/1990 | Robinson | 36/25 R X |
| 5,491,912 | 2/1996 | Snabb et al. | 36/114 |
| 5,507,106 | 4/1996 | Fox | 36/103 |
| 5,592,757 | 1/1997 | Jackinsky | 36/25 R X |

FOREIGN PATENT DOCUMENTS

| | | | |
|---|---|---|---|
| 4018518 | 1/1991 | Germany | 36/103 |
| 4073001 | 3/1992 | Japan | 36/25 R |
| 5277001 | 10/1993 | Japan | 36/103 |
| 1676582 | 9/1991 | U.S.S.R. | 36/25 R |
| 8304166 | 12/1983 | WIPO | 36/103 |

*Primary Examiner*—B. Dayoan
*Attorney, Agent, or Firm*—James M. Deimen

[57] ABSTRACT

New application of biomechanical principles of elastic stretch and braking force are combined in an athletic shoe. The new design implements the concepts by placing the heel of the shoe inner sole significantly lower than the ball of the foot and toes. Tests show that an inner sole reverse slope of about 3½° provides an optimum significant improvement in jumping in particular. The reverse slope is substantially flat from the center of pressure beneath the heel to the five centers of pressure beneath the ball of the foot. The flat slope provides more assurance that the weight of the user will be applied to the shoe through the centers of pressure in preference to locations under the arch. The invention is applicable to "explosive" movement sports such as basketball, track and field, volleyball, tennis and soccer. Preferably the shoes are constructed with formed or curved heels to retain the feet properly positioned in the shoes by preventing the feet from sliding too far back within the shoes. The increased athletic performance appears to arise from a two fold effect. First, the reverse slope because of the toe elevation additionally stretches the achilles tendon resulting in the ability to generate greater jumping force as the calf muscle contracts. Second, the reverse slope because of the continuous flat nature of the slope, provides a greater stopping or braking force, thus improving the ability to convert forward momentum into vertical or lateral motion. In a second embodiment the shoe inner sole not only slopes upward from the heel longitudinally but also has the steepest slopes underlying the user's heel and ball of the foot. The result is a greater braking force on the user's foot which in turn improves the ability to convert forward momentum into vertical and lateral motion.

15 Claims, 2 Drawing Sheets

ATHLETIC SHOES WITH REVERSE SLOPE SOLE CONSTRUCTION

BACKGROUND OF THE INVENTION

This application is a continuation-in-part of application Ser. No. 08/166,243, filed Dec. 13, 1993 now U.S. Pat. No. 5,491,912, which is a continuation-in-part of application Ser. No. 07/896,222, filed Jun. 10, 1992 now abandoned.

The field of the invention pertains to athletic shoes and, in particular, to athletic shoes specifically for use in "explosive" sports such as basketball, track and field, volleyball, tennis and soccer.

Modern athletic shoes for sports, in particular sports with explosive movements, are designed and constructed to place the heel significantly higher than the ball and the toes of the foot. Typically the slope of the inner sole is approximately 4° with the inner sole being higher at the heel relative to the ball and toes. Thus the inner sole has a forward (positive) slope. Such athletic shoes are constructed in this manner to provide better shock absorption and greater comfort. The forward slope provides a tendency to lift the arch of the foot from the inner sole when braking thus protecting the arch from injury.

For certain specific purposes other than athletics, shoes have been disclosed with the heel inner sole lower than the inner sole at the ball of the foot and toes. Perhaps the best known example is disclosed in U.S. Pat. No. 3,305,947, the "earth shoe" wherein the heel inner sole is level with or slightly lower than the inner sole at the ball of the foot. This shoe is a walking shoe commercially sold as a sandal with straps and not suited for vigorous athletic activities beyond walking.

U.S. Pat. No. 3,964,181 discloses a shoe to improve the posture of a wearer but nevertheless appear as a conventional shoe. The heel portion is substantially hollowed out to put the heel at 2°–10° reverse slope below the ball of the foot. The inner sole is substantially curved both laterally and longitudinally between the heel and ball of the foot. The preferred slope is 5°. The shoe construction is specifically directed to overcome the sandal appearance and fitting problems of the "earth shoe" design and be applicable to dress shoes and casual shoes such as wing tips, moccasins, brogues and wedges. Thus, this shoe construction is not directed to vigorous athletic activities.

A walking shoe for enhanced exercise is disclosed in U.S. Pat. No. 4,934,073. A reverse slope convex wedge is positioned ahead of the heel and terminating before the heel. The convex wedge also terminates before the ball. Here again, the shoe is not directed to vigorous athletic activities beyond walking. Both of the above walking shoes purposely provide arch support and with such arch support at least a portion of the user's weight is applied through the arch.

All these shoe designs use either an inner sole design that provides for ample arch support or the shoes do not maintain their original inner sole design under the loads encountered when in use. These designs are unacceptable for negative sloped athletic shoes used in competitive, explosive sports.

A number of devices have been specifically developed for physical therapy that embody a severe reverse slope. U.S. Pat. No. 2,769,252 discloses a block affixed to the exterior shoe sole under the ball of the foot and toes. The block creates a severe reverse slope. The shoe construction is to aid in the strengthening of the abdominal muscles by causing an abnormal walking posture. The shoe design clearly would be unsuitable for athletic activities beyond the intended walking exercise.

U.S. Pat. No. 3,472,508 and U.S. Pat. No. 4,573,678 disclose severe reverse slope devices for exercising the lower leg. Both devices are attached to the feet with straps, the former being intended for feet without shoes and the latter intended for feet in athletic shoes. The former device also provides for an adjustable slope. Both devices are intended for walking with the devices strapped on, however, they are too cumbersome and dangerous for vigorous sports activities.

U.S. Pat. No. 4,526,365 discloses a platform device having a resilient wedge shaped member under the toes and ball of the foot. The wedge creates a reverse slope relative to the heel support of the device. The March 1992 issue of Track & Field News on page 57 refers to platformed spikes by NIKE® as training and competition shoes having a platform on the front, however, no illustration or detailed explanation is provided.

SUMMARY OF THE INVENTION

The new athletic shoes are constructed with the heel significantly lower than the ball of the foot and toes to provide a reverse slope inner sole. The inner soles of the shoes increase in height at a constant rate from the horizontal beginning at the center of pressure of the heel and extending beyond the five centers of pressure in the ball of the foot before leveling off to a constant thickness or 0° slope. For purposes of this disclosure the center of pressure of the heel comprises the portion of the heel beneath the rearward portion of the calcaneus bone. Similarly, the five centers of pressure of the ball comprise the portions of the ball beneath the forwardmost portions of the tarsal bones. These definitions encompass the various centers of pressure that change position on the foot depending on the position of the foot as the foot and shoe strike the ground whether jumping or braking. In a dynamic situation (running, jumping, braking) the overall center of pressure of the foot moves generally on a path from the heel to the ball. The inner sole reverse slope is substantially flat both laterally and longitudinally from the center of pressure beneath the heel to the five centers of pressure beneath the ball of the foot. If the increasing height is discontinued before the ball of the foot, the braking effect of the reverse angled inner sole will be reduced. This will negatively affect the shoes' performance enhancement. However, leveling off the soles' increasing thickness near the toe of the shoe will not decrease its braking effect and will provide a takeoff surface angle more perpendicular to the direction of motion. This will result in a more effective final ball/toe pushoff. Furthermore, the flat reverse slope design has been found to be more comfortable when the inner sole is level near the toe.

By using the flat reverse slope design placing the heel lower than the ball, tests by applicants have shown that explosive movement such as running and jumping are substantially improved. The athlete can jump higher and farther and can run faster. The tests have shown that the optimum reverse or negative slope of the inner sole from the center of pressure of the heel to the ball centers of pressure is about 3½°. The flat reverse slope provides more assurance that the weight of the user will be applied to the shoe through the centers of pressure in preference to locations under the arch. Thus, the arch of the foot, which is relatively weak is protected in sudden stops and braking. Preferably, the shoes are constructed with formed or curved heels to retain the feet properly positioned in the shoes by preventing the feet from sliding too far back within the shoes.

The increased athletic performance appears to arise from a two fold effect. First, the reverse slope tends to additionally stretch the achilles tendon resulting in the ability to generate greater jumping force as the calf muscle contracts. Second, the continuous nature of the flat reverse slope provides a greater stopping or braking force, thus improving the ability to convert forward momentum into vertical or lateral motion. Since the instantaneous weight of the user can increase ten to twelve fold in sudden braking, a continuous negative flat slope from the heel center of pressure to the ball centers of pressure of the foot retained a proper negative flat slope under such increased weight is very important to reduce the likelihood of excessive impact load on the arch.

In summary, improved performance is seen in three areas of explosive motion:

a) Increased vertical jump height b) Increased acceleration and foot speed c) Quicker directional changes and stops d) Reduced likelihood of foot injury In a second embodiment the new improved negative sloped athletic shoes have a unique inner sole design wherein the inner sole is elevated above the planer outer sole at a location defined by the ball of the foot being higher relative to the outer sole than the inner sole is elevated above the outer sole at a location defined by the heel of the foot therein. In forming the negative slope, the inner sole surface steepest negative slopes occur under the heal and ball of the user's foot.

The second embodiment increases the ground reaction braking forces on the user's heel and ball relative to the first embodiment flat slope design while maintaining the optimal achilles stretch. Therefore, the user can obtain further improvement in explosive braking forces. In addition, the second embodiment further reduces the possibility of injury to the arch of the foot by placing a higher percentage of the total ground reaction forces on the user's foot at the ball and heel, locations which can withstand larger impact forces. The sharing of large ground reaction forces between the ball and heel of a foot prevents either the ball or heel from being subjected to larger forces that have the potential to inure the foot.

In order to correctly design the inner sole surface to maximize athletic performance and concurrently reduce injury potential to the arch of the foot, three basic design criteria are incorporated as follows:

First, as described above, there exists an optimal negative slope or angle that maximizes the power generated by the achilles tendon. For most athletes this angle is about 3.5 degrees. Improved power is found at negative slopes of 1 degree to 5 degrees. Therefore, the shoe inner sole surface should slope downward longitudinally from a location underlying the point where the arch of the foot is adjacent to the ball, to the location underlying the center of pressure of the heel. For purposes of this discussion the center of pressure at the heel comprises the portion of the heel beneath the rearward portion of the calcaneus bone. A straight line connecting these two points on the inner sole surface forms an angle relative to the plane of the outer sole of 3.5 degrees (1 degree to 5 degrees). This geometry stretches the achilles tendon to its maximum power generating position. This angle is the "maximum power angle" of the shoe.

Second, the increased athletic performance arises from a two-fold effect. As stated above the negative slope tends to additionally stretch the achilles tendon resulting in the ability to generate greater force as the calf muscle contracts. Additionally, the longitudinally negative sloped inner sole surface under the ball and heel of the user's foot induces a greater ground reaction force on the user's ball and heel than the original negative slope designed shoe. The larger the longitudinal slope of the surface underlying and supporting the user's ball and heel, the greater the ground reaction braking force on the ball and heel. This results in an improved ability by the user to convert forward momentum into vertical or lateral motion.

Also, the inner sole surface supporting the ball and heel should be flat longitudinally and laterally. This design dissipates the large braking forces' impact energy evenly across the ball and heel of the foot. If the surface underlying the ball or heel is not flat the forces on the heel or ball will concentrate at the most curved portions, thus increasing the possibility of injury.

Third, when humans engage in dynamic locomotion such as running, jumping and braking, the supporting foot is subjected to vertical ground reaction forces of up to twelve times body weight and horizontal ground reaction forces of up to two times body weight. This is of particular concern when designing reverse slope athletic shoes because a reverse slope is inherently more likely than standard forward sloping shoes to make the arch the major load bearing surface. There are two reasons for this.

First, the reverse slope design tends to flatten the arch of the foot which is not the case for standard forward slope shoes. If not considered for the inner sole surface design, this flattening, when combined with the high vertical forces encountered in dynamic locomotion, can lead to excessive forces on the arch of the foot.

Second, when braking, unlike forward sloping shoes where the foot tends to pull away, thus protecting the arch, in the reverse slope shoe design the foot pushes into the upward sloping surface potentially exposing the arch to large forces. Therefore, it is imperative that the potential for injury to the arch be taken into account when designing reverse slope shoes to be used for running, jumping and braking. To avoid potential injury, the large horizontal and vertical ground retention forces need to be concentrated under the heel and ball of the foot, and not on the arch of the foot.

As stated above the inner sole surface design including larger negative slopes underlying the ball and heel of the foot concentrates the ground reaction forces on the heel and ball of the foot, the areas that can withstand these forces, and away from the arch, the area that cannot. The inner sole surface under the arch can be designed in two ways.

By maintaining a flat longitudinal and lateral surface under the entire length of the arch with a longitudinal negative slope less than or equal to the longitudinal slopes of the surfaces under the ball and under the heel will reduce the total force on the arch and evenly distribute the forces that do impact the arch, thus preventing the concentration of forces on any specific area of the arch.

An alternative inner sole surface design underlying the arch is to smoothly curve the inner sole surface longitudinally downward away from the arch of the foot. This design will protect the arch from the ground reaction forces but offers a minimum of arch support.

An inner sole surface design underlying the arch that cannot be used is one that rises toward the arch of the foot or curves upward toward the arch and retains this shape under load. For currently marketed athletic shoes this is the typical inner sole arch support design. However, if applied to a negative sloped inner sole, this design additionally exposes the arch to the high ground impact forces and concentrates these forces in a particular area on the user's arch which is not desirable from a potential injury standpoint.

The new improved negative sloped athletic shoes are constructed with any suitable sole material that will properly support and cushion the user's foot while retaining the new inner sole, design when subjected to a load that is multiple times the weight of the user. Under load the shape of the inner sole is most important to support the ball and heel and to protect the arch. Under no load the inner sole shape may or may not be the same as under load depending upon the inner sole material.

The outer sole surface is flat longitudinally and laterally and level with the underlying surface it contacts. The inner sole surface design is flat laterally and level laterally with the planar outer sole. The inner sole surface design is segmented longitudinally into five sections.

Extending forward from the rear of the heel to just before the center of pressure of the heel, the inner sole underlying support surface longitudinally curves upward toward the rear. This maintains the user's foot properly positioned in the shoe by preventing the foot from backsliding.

The inner sole surface design is substantially flat and level laterally relative to the planar outer sole and flat longitudinally from under a location defined by the center of pressure at the heel forward to under a location defined by the location where the heel is adjacent to the arch of the foot. This surface has a distinct longitudinally negative slope that is greater than or equal to the shoe maximum power angle and within an angular range of zero to 15 degrees relative to the shoe maximum power angle.

The inner sole surface design is substantially flat and level laterally relative to the planar outer sole and has substantially no longitudinally upward curved surface curving toward the arch of the foot underlying and supporting the entire length of the arch of the foot.

The inner sole foot supporting surface design is substantially flat and level laterally relative to the planar outer sole and flat longitudinally from under a location defined by where the arch of the foot is adjacent the ball of the foot forward to at least under a location defined by the five centers of pressure at the ball of the foot. For purposes of this discussion the five centers of pressure at the ball comprise the portion of the ball beneath the forwardmost portions of the tarsal bones. The surface has a distinct longitudinally negative slope that is greater than or equal the shoe maximum power angle and within an angular range of zero to 15 degrees relative to the shoe maximum power angle.

The inner sole foot supporting surface extending from just beyond the ball of the foot forwardmost centers of pressure to the tips of the toes has two distinct possible designs that are used by most currently marketed athletic shoes and are the preferred embodiments for this design. The inner sole surface is flat laterally and level laterally with the planar outer sole. This portion of the inner sole surface design longitudinally levels off to a slope of zero degrees under the toes relative to the outer sole. This zero degree design is best suited for the combination of running, jumping and braking. In the alternative, the inner sole surface design can taper downward toward the outer sole thereby decreasing the sole thickness under the toes. This design is best suited for running. Both designs are comfortable and provide effective final ball/toe pushoffs.

DESCRIPTION OF THE PREFERRED EMBODIMENTS

Figure 1:
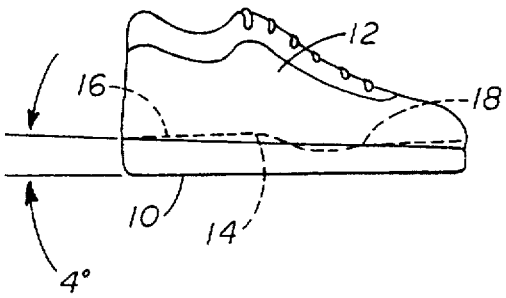
FIG 1 PRIOR ART
FIG. 1 illustrates schematically the current shoe design with a positive slope.

In FIG. 1 the typical prior art athletic shoe design is illustrated. The shoe comprises an outer sole 10 and upper 12 attached thereto. Within the shoe is an inner sole 14 stepped or sloped downwardly from the heel 16 toward the ball of the foot and toes at 18. The slope is about 4° positive as indicated.

Figure 2:
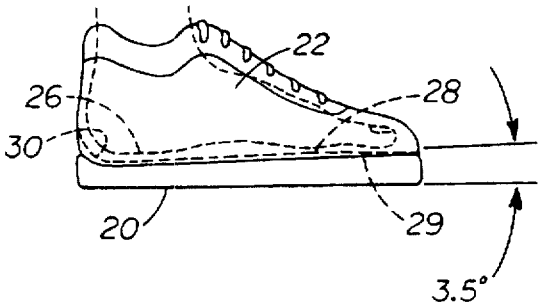
FIG. 2 illustrates schematically the new shoe design with a negative slope.

FIG. 2 illustrates the new shoe with an outer sole 20 and upper 22 attached thereto. Within the shoe is an inner sole 24 sloped upwardly relative to the horizontal from the heel 26 toward the ball of the foot at 28. These locations 26 and 28 are the approximate centers of pressure at the heel and ball respectively as shown in FIG. 2. The slope is preferably about 3½° negative or reverse as indicated. The slope is preferably changed to 0° under the toes as indicated at 29. The inner sole 24 is substantially flat both laterally and longitudinally from rearward the center of pressure of the heel to forward of at least the five centers of pressure of the ball of the foot. The centers of pressure are the weight bearing locations on the foot wherein the bone structure causes the weight of the user to be concentrated in normal standing, walking or running. These locations on the foot are most able to withstand the sudden impact loading of jumping and braking which may increase the instantaneous load on the foot to ten to twelve times the weight of the user.

Figure 3:
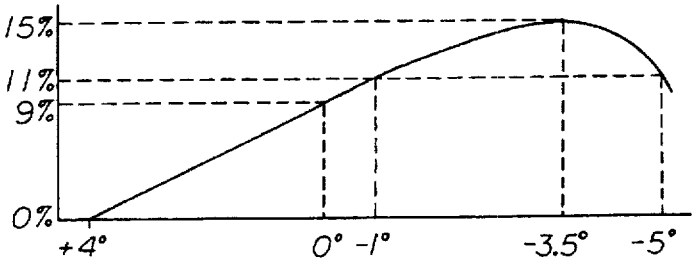
FIG. 3 is a graph of percentage increase in performance in jumping versus the angle of the shoe inner sole construction.
Figure 4A:
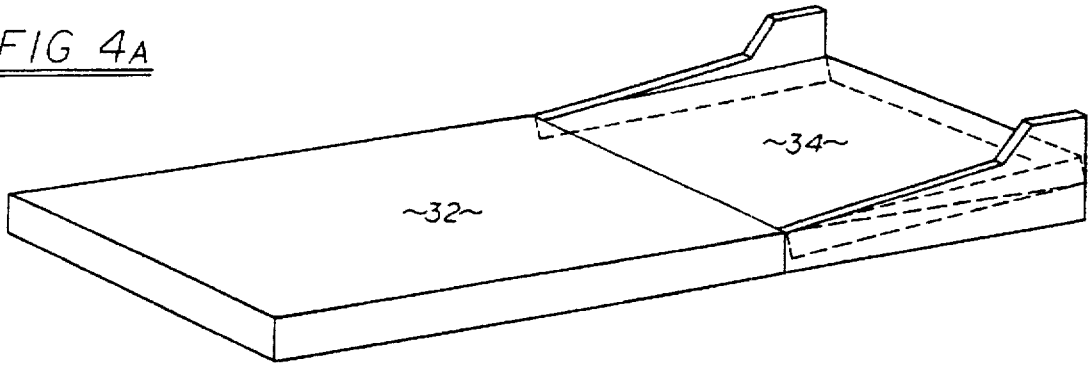
FIG. 4A is a perspective view of an adjustable test platform to simulate a negative slope athletic shoe.
Figure 4B:
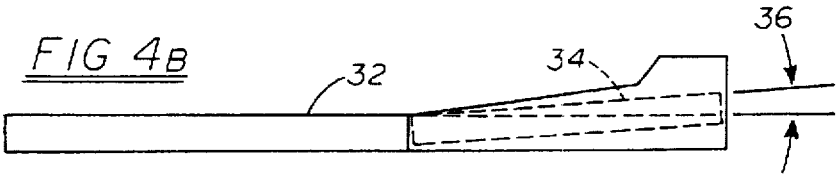
FIG. 4B is a side view of the test platform.
Figure 4C:
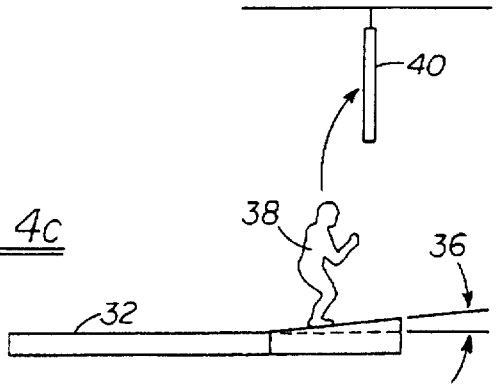
FIG. 4C illustrates the jump test on the platform.
Figure 5:
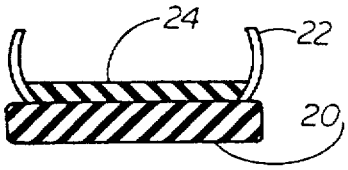
FIG. 5 is a partial transverse sectional view of the shoe taken between the heel and ball centers of showing a laterally flat inner sole.

The preferred negative slope was determined through extensive testing by the applicants, one of whom is a professor of kinesiology at the University of Michigan, Ann Arbor, Mich. The test results for vertical jump are summarized in the graph shown in FIG. 3 and are based on one of two completed vertical height studies. The vertical height studies were performed as a result of initial tests with modified athletic shoes. To assume uniformity of test procedure, the adjustable test platform shown in FIG. 4 was constructed. The test platform comprises a fixed level portion 32 and a tiltable portion 34. The tiltable portion is supported securely at each selected test angle 36. Each test athlete can be tested barefoot or with the same shoes at all test slopes, thereby eliminating shoe variability. As shown in FIG. 4C each test subject 38 jumped to touch a backboard 40.

The first study was of the standstill two foot jump. The reverse slope design resulted in an increase in jump height of, on average, eight percent over the current shoe design (4° positive slope). The second study was on the two foot jump with a one and a half step approach. The reverse slope design produced a fifteen percent increase in jump height relative to the current shoe design and is shown in FIG. 3. A preliminary study using a higher speed approach and a one foot takeoff indicates even greater percentage increases are possible.

FIG. 3 illustrates that the improvement begins with a lessening of the slope from the current 4° positive and a peak improvement occurring at about 3.5° negative. Further negative slope beyond 3.5° results in a fall off in improvement that becomes drastic beyond 5°. Thus, for substantial improvement in athletic performance based on the tests shown in FIG. 3, the sole slope should be between 1° and 5° negative but preferably 3½ negative.

Based upon more informal trials and use by the applicants in competitive sports, basketball, volleyball and tennis, an immediately apparent significant improvement in performance was experienced. The testing has also shown that a curved heel as indicated in FIG. 2 at 30 is beneficial to prevent sliding backward in the shoe. Moreover, the applicants have determined from the testing that braking and cutting in explosive sports is enhanced by the negative slope, in particular, the negative slope shown in FIG. 2 wherein the slope is flat and constant from the center of pressure of the heel 26 to the ball centers of pressure of the foot 28. Forward of the ball 28 centers of pressure the negative slope is decreased to 0° under the toes at 29. The change in slope occurs beyond the ball centers of pressure as shown.

Any suitable inner sole material that will properly support and cushion the foot while retaining the proper negative flat slope under the increased load of braking may be used. A wide variety of such materials and constructions have been developed in recent years. As an alternative for athletes that may wish to further "tweak" their shoes to enhance their personal performance or to eliminate the reverse angle when not competing, the ball of the foot and toe portion of the inner sole or the heel of the inner sole may be constructed of open cell foam material with the surface sealed air tight. Connecting the inner sole to an athletic shoe air pump permits the inner sole to be pumped up or bled to adjust the effective negative slope. Fitted inserts placed on the inner sole can also accomplish the adjustment of the slope.

The eight percent and fifteen percent improvements obtained in the tests above can be translated into enhanced performance improvement by highly trained talented competitors at the professional or Olympic level. Such improvements on this order are to be very unexpected from flattening and a change of a few degrees in the slope of the inner sole of the shoe. Yet they can be expected because the tests were performed with well trained athletes from a local University under the supervision of one of the applicants. Moreover, the research shows that the optimum reverse angle of 3½° applies not only to the well trained athletes but also to other individuals regardless of size, strength or conditioning.

Figure 6:
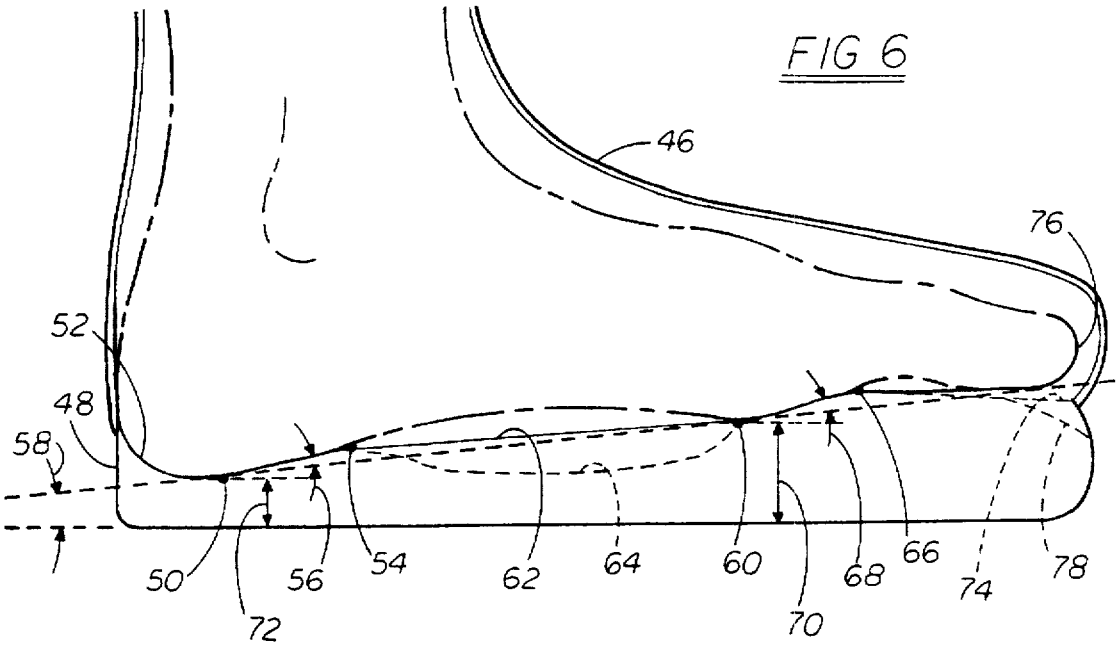
FIG. 6 illustrates schematically a longitudinal view of the new second embodiment shoe design with a negative slope.
Figure 7:
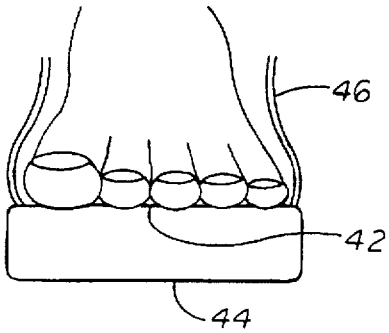
FIG. 7 illustrates schematically a lateral view of the new shoe design of FIG. 6.

In FIGS. 6 and 7 the second embodiment of the new negative sloped athletic shoe for running, jumping and braking is shown. The inner sole 42 in FIG. 7 is flat laterally and transversely level with the outer sole 44. They are attached to an upper 46. The shoe upper 46 is preferably made of canvas, leather or any other composite materials used currently in the manufacture of athletic shoes. The design of the shoe upper 46 is conventional. The upper 46 is attached to at least one of the outer 44 and inner 42 soles adjacent the periphery thereof. The design of the inner sole surface is the key to the increased athletic performance experienced when using the new shoes.

From the rear 48 of the sole to just before the heel center of pressure 50 a curved inner sole heel support 52 is indicated to prevent backsliding by the user's foot. From heel pressure point 50 to point 54 the inner sole surface underlying the heel of the foot slopes upward 56 in an angular range of zero to 15 degrees relative to the maximum power angle (58 of 3.5 degrees, range 1 to five degrees). The increased slope under the heel will convert forward momentum into vertical or lateral motion more effectively as the angle 56 is increased.

From point 54 to point 60 the inner sole surface 62 underlying the arch of the foot is flat longitudinally in order to dissipate the ground reaction forces evenly over the entire surface of the arch of the foot. An alternative inner sole surface design underlying the arch of the foot from point 54 to point 60 has the sole surface 64 curving downward away from the user's arch, thus providing protection from the ground reaction forces produced when running, jumping and braking.

From the point 60 to point 66 beyond the ball of the foot, the inner sole surface underlying the ball of the foot is flat longitudinally and slopes upward in an angular range 68 of zero to 15 degrees relative to the maximum power angle (58 of 3.5 degrees, range 1 to 5 degrees). The increased slope under the ball of the foot converts forward momentum into vertical or lateral motion more effectively as the angle 68 is increased.

The height 70 of the sole at point 60 on the inner sole surface supporting a point on the foot where the arch is adjacent the ball of the foot relative to the height 72 of the sole at point 50 on the inner sole surface supporting the center of pressure of the user's heel forms the angle 58 of 3.5 degrees (range 1 to 5 degrees), which is the maximum power angle. The inner sole surface 74 extending forward from the point 66 underlying the point on the foot where the ball is adjacent to the toes to the tip of the toes 76 levels off to a longitudinal slope of zero degrees under the toes. The shoe sole has a constant thickness from just forward of point 66 to the tip of the toe 76. An alternative toe design 78 tapers the thickness of the sole from point 66 forward to the tip of the toes 76.

We claim:

1. A running, jumping and braking athletic shoe comprising a planar outer sole and an inner sole thereabove, an upper attached to at least one of the outer sole and inner sole adjacent the periphery thereof, the inner sole elevated above the outer sole at a point defined by a juncture of a ball and arch of a foot being higher than the inner sole is elevated above the outer sole at a location defined by a heel center of pressure of a foot to form an inner sole negative slope, the improvement comprising the inner sole being substantially flat laterally across the shoe and being divided longitudinally into two substantially flat surfaces separated by a third surface beneath the arch of a foot, the three surfaces extending from a point just rearward of a location defined by the center of pressure at the heel at least to locations defined by the centers of pressure at the ball, said two substantially flat surfaces having longitudinally negative slopes in excess of the inner sole negative slope defined by the elevation of the ball and arch juncture point above the heel center of pressure.

2. The athletic shoe of claim 1 wherein the inner sole negative slope is within an angular range of 1° to 5° relative to the planar outer sole.

3. The athletic shoe of claim 1 wherein the inner sole negative slope is at an angle of 3½° relative to the planar outer sole for optimum enhancement of athletic performance.

4. The athletic shoe of claim 1 wherein the inner sole is curved upwardly rearwardly of the heel center of pressure to prevent backsliding of the foot within the shoe.

5. The athletic shoe of claim 1 wherein the thickness defined by the inner sole and outer sole is substantially constant in thickness from the centers of pressure of the ball of the foot forward under the toes.

6. The athletic shoe of claim 1 wherein the slope of at least one of the two substantially flat surfaces exceeds the inner sole negative slope by up to 15°.

7. The athletic shoe of claim 1 wherein the surface beneath the arch of the foot curves beneath the inner sole negative slope.

8. The athletic shoe of claim 1 wherein the inner sole negative slope defines the power angle of the shoe.

9. A running, jumping and braking athletic shoe comprising a planar outer sole and an inner sole thereabove, an upper attached to at least one of the outer sole and inner sole adjacent the periphery thereof, the inner sole elevated above the outer sole at a point defined by a juncture of a ball and arch of a foot being higher than the inner sole is elevated above the outer sole at a location defined by a heel center of pressure of a foot to thereby define a power angle for the shoe, the improvement comprising at least a portion of the inner sole being divided longitudinally into two substantially flat surfaces separated by a third surface beneath the arch of a foot, the two substantially flat surfaces being substantially flat laterally across the shoe, the three surfaces extending from a point just rearward of a location defined by the heel center of pressure at least to locations defined by the centers of pressure at the ball, said two substantially flat surfaces having longitudinally negative slopes in excess of the power angle of the shoe.

10. The athletic shoe of claim 9 wherein the power angle has a range of 1° to 5°.

11. The athletic shoe of claim 9 wherein the power angle is 3½°.

12. The athletic shoe of claim 9 wherein the inner sole is curved upwardly rearwardly of the heel center of pressure.

13. The athletic shoe of claim 9 wherein the slope of the inner sole forwardly of the centers of pressure of the ball of the foot and under the toes decreases from the power angle.

14. The athletic shoe of claim 9 wherein the slope of at least one of the two substantially flat surfaces exceeds the power angle by up to 15°.

15. The athletic shoe of claim 9 wherein the surface beneath the arch of a foot curves beneath the power angle.

* * * * *